US005735758A

United States Patent [19]

Miketinac

[11] Patent Number: 5,735,758

[45] Date of Patent: Apr. 7, 1998

[54] GOLF TEE INSERTION HEIGHT GAUGE

[76] Inventor: John S. Miketinac, Box 269A, Pikeville, Tenn. 37367

[21] Appl. No.: 612,122

[22] Filed: Mar. 7, 1996

[51] Int. Cl.[6] ..... A63B 57/00

[52] U.S. Cl. ..... 473/386

[58] Field of Search ..... 473/386, 284, 473/387, 400, 405, 406, 407, 408; D21/208

[56] References Cited

U.S. PATENT DOCUMENTS

| | | | |
|---|---|---|---|
| D. 302,714 | 8/1989 | Chatham | D21/208 |
| D. 314,922 | 2/1991 | Musillo | D21/208 |
| D. 321,544 | 11/1991 | Axne | D21/208 |
| D. 344,779 | 3/1994 | Axne | D21/234 |
| 1,616,059 | 2/1927 | Mulvehill . | |
| 1,625,911 | 4/1927 | Richards . | |
| 1,936,625 | 11/1933 | Goldman . | |
| 3,114,557 | 12/1963 | Cabot . | |
| 3,203,700 | 8/1965 | Antonious . | |
| 3,312,468 | 4/1967 | Lynch | 473/386 |
| 3,658,331 | 4/1972 | Driscoll . | |
| 3,671,037 | 6/1972 | Murdock, Jr. | 473/386 |
| 4,063,731 | 12/1977 | Kitay . | |
| 4,896,883 | 1/1990 | Wagenknecht | 473/386 |
| 4,982,510 | 1/1991 | Musillo | 473/386 |

FOREIGN PATENT DOCUMENTS

| | | |
|---|---|---|
| 219242 | 12/1958 | Australia . |

*Primary Examiner*—Steven B. Wong
*Attorney, Agent, or Firm*—Troutman Sanders LLP; Scott M. Frank; Gerald R. Boss

[57] ABSTRACT

A golf tee insertion height gauge for use in accurately positioning the head of a golf tee a desired height above the ground upon insertion of the golf tee into the ground. The golf tee insertion height gauge is constructed of a sheet of material using a peripheral edge. Disposed in the sheet material is at least one tee receiving aperture which is completely open and extends inward from the peripheral edge of the sheet of material such that it is capable of accepting portions of a tee.

1 Claim, 1 Drawing Sheet

GOLF TEE INSERTION HEIGHT GAUGE

FIELD OF THE INVENTION

This invention relates to gauges for insertion of golf tees into the ground and, in particular, relates to a golf tee insertion gauge which provides for the head of a golf tee to be a known height above the ground upon insertion.

BACKGROUND OF THE INVENTION

In playing the game of golf, one of the primary goals of the participant is to minimize the number of variables which might contribute to poor performance. In general, simply hitting the ball properly on a routine basis challenges all but the most expert golfer. The golf swing is a very complicated and involved act which requires substantial practice and repetition to evolve to the point where a player can count on the result. However, even if the player has developed a regular, established swing, a number of external variables may affect the shot of the player. For example, if the head of the tee on which the golfer places a ball is too high or too low, a player utilizing their normal swing may strike the ball improperly. Additionally, the appearance that the ball is too high or too low may psychologically affect the player and prevent the player from performing his or her standard swing.

Thus, in addition to proper swing training, a player may improve his or her golf game by minimizing irregularities which might affect the player's swing. One such variable that can be eliminated is irregularities in the height above ground of the head of a golf tee, and subsequently the ball. This variable can be eliminated by use of a golf tee insertion height gauge.

The use of a gauge to uniformly insert a golf tee into the ground such that the head of the tee is a desired height above the ground, or turf, is known in the art. For example, U.S. Pat. No. 3,658,331, describes a gauge in which a rim on the head of the golf tee engages a notch in a slot, which determines how far the head of the golf tee will extend above the ground upon insertion of the tee into the ground. However, this gauge has drawbacks.

For example, this type of gauge has a central slot which is substantially wider than the shank portion of the golf tee; thus, the tee will tend to move within the slot of the gauge, making insertion into the ground difficult. Furthermore, golf tees are not of uniform size. For example, there are a wide range of diameters of the head of a golf tee as well as the angle at which the head of the tee tapers to the shank. Thus, where a gauge has notches which are to be engaged by the head of the tee, it is likely that some tees will be too large to fit within the notch, too wide to fit within the slot, or two small to engage the notches and, thus, can not be used with the gauge (or, more likely, the gauge will not be used). Finally, such types of gauges do not make very secure contact with the head of the tee which will make insertion into hard ground difficult.

Another type of insertion gauge is shown in U.S. Pat. No. 4,982,510, in which the gauge generally resembles half of a mold of a golf tee. In this device, the tee is laid within a pocket shaped like the tee. Half of the tee extends above the gauge. The portion of the tee to be inserted into the ground extends beyond the edge of the gauge. In use, the tee is placed within the desired pocket and then the portion of the shank extending beyond the edge of the gauge inserted into the ground.

However, this design suffers from some substantial shortcomings. First, since the gauge must be at least as deep as half of the tee (plus additional material so that the pocket does not pass completely through the gauge), the thickness of the device makes it generally uncomfortable to store in a players pocket during a round of golf. Also, the thickness contributes to production costs, because of the additional raw materials used.

Furthermore, there are functional drawbacks as well. Since the head of the tee extends out of the pocket, any force exerted on the tee during insertion by the gauge will be directed at one side of the tee head. Much like hitting the head of a nail off-center with a hammer, this application of force will tend to result in the tee being placed into the ground at an angle, which is undesirable. Such uneven application of force will also tend to force the tee out of the gauge before insertion is completed; thus marring either the accuracy of insertion of the tee to achieve the proper height, or causing the player to have to reinsert the tee. These problems are especially noticeable when using the shorter pockets because, unlike the longer pockets where a finger may be placed on the shank of the golf tee to stabilize the tee as it is inserted into the ground, a finger may only be applied to one side of the head of the tee (a very small portion of the entire tee). These problems are further amplified in a situation in which the ground is very hard and a greater force is required to insert the tee into the ground. Finally, since this type of gauge is closed on one side, placing a tee into the gauge and gripping the tee and gauge for insertion of the tee into the ground is complicated.

SUMMARY OF THE INVENTION

It is therefore an object of the present invention to provide a golf tee insertion height gauge to allow for the uniform positioning of the head of the golf tee a desired height above the ground.

It is a further object of the present invention to provide a golf tee insertion height gauge in which a tee may be easily placed within the gauge and held within the gauge while the tee is being inserted into the ground.

It is yet a further object of the present invention to provide a golf tee insertion height gauge which is thin enough to be comfortably carried in a pocket or otherwise conveniently carried without substantial distraction.

It is a still further object of the present invention to provide a golf tee insertion height gauge which will transmit insertion force uniformly to the head of a golf tee being inserted into the ground.

It is a further object of the present invention to provide a golf tee insertion height gauge having an aperture generally corresponding in shape to the shape of a golf tee for improved retention of the golf tee in the insertion gauge during insertion of the golf tee into the ground.

These and other objects are accomplished with the golf tee insertion height gauge made in accordance with the preferred embodiment of the present invention. In a preferred embodiment, there is provided a golf tee insertion height gauge for use in accurately positioning the head of a golf tee a desired height above the ground upon insertion of the golf tee into the ground. In this embodiment, the golf tee insertion height gauge is constructed of a sheet of material between about ⅛" and 5/16" thick and has a peripheral edge. Disposed in the sheet material is at least one tee receiving aperture which extends inward from the peripheral edge of the sheet of material.

In a preferred embodiment, the tee receiving aperture completely passes through the sheet and is open on the peripheral edge. The aperture further comprises the head conforming portion which has a conical cross section shape which is sized to accept the head of the golf tee and defines an upper limit for movement of the golf tee placed within the tee receiving aperture. The aperture further includes a shank conforming portion which corresponds in shape to the cross section of the shank of a golf tee. Preferably, this portion has a width on the order of the diameter of the shank of a golf tee. In a preferred embodiment, the shank conforming portion and head conforming portion of the aperture is positioned relative to the peripheral edge of the sheet of material so that the distance between the upper limit of the head conforming portion of the aperture to the peripheral edge corresponds to the desired height above ground at the head of the golf tee. In the preferred embodiment, when a tee is placed within the tee receiving aperture, at least a portion of the shank of the tee will extend beyond the peripheral edge of the gauge with the protruding portion of the tee being the portion to be inserted into the ground.

In a further embodiment of the invention, the sheet material is preferably 3/16" thick. In other embodiments of the invention, the height gauge may be made of plastic or metal.

In a further preferred embodiment, the sheet of material is preferably rectangular and thus, has four peripheral edges. An alternate embodiment of the present invention, the sheet of material may be circular, triangular or any other polygonal shape. Regardless of the shape of the embodiment of the present invention, preferably the shank conforming portion is disposed perpendicular to the peripheral edge to which it opens. For the purpose of a circular shaped sheet of material, the shank conforming portion would be perpendicular to a line tangent to the peripheral edge at the location on the peripheral edge where the aperture opens.

BRIEF DESCRIPTION OF THE DRAWING

The above described invention may be best understood with reference to the following detailed description of a preferred embodiment and the drawings in which.

DETAILED DESCRIPTION OF A PREFERRED EMBODIMENT

Figure 1:
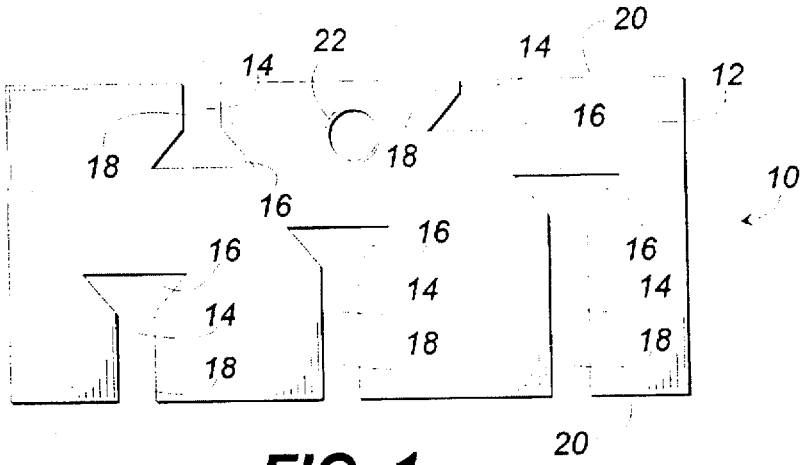
FIG. 1 is a plan view of the preferred embodiment of the present golf tee insertion height gauge.

Referring now to the figures in which like reference numerals indicate like or corresponding features, there is shown in FIG. 1 the preferred embodiment of a golf tee insertion height gauge. Preferably, the golf tee insertion height gauge is made of a sheet 12 which is relatively thin and at least semi-rigid. Typically, the thickness of the sheet would be between about 1/8" to 5/16" thick. The sheet is preferably made of plastic, but also may be made of a suitable metal material such as aluminum. Provided in the sheet 12 is a number of key receiving apertures 14. These tee receiving apertures include a head portion 16 and a shank portion 18. The head portion 16 is preferably sized to accommodate the average typical golf tee head. Typically, the width of the head portion 16 will be less than 1". The head portion 16 has a conical shape and tapers to the shank portion 18. The shank portion 18 of the aperture 14 extends from the head portion 16 to the peripheral edge 20 of the sheet 12. As can be seen from FIGS. 1 and 2, the shank portion 18 of the aperture 14 is open on the peripheral edge 20 of the sheet 12.

Figure 2:
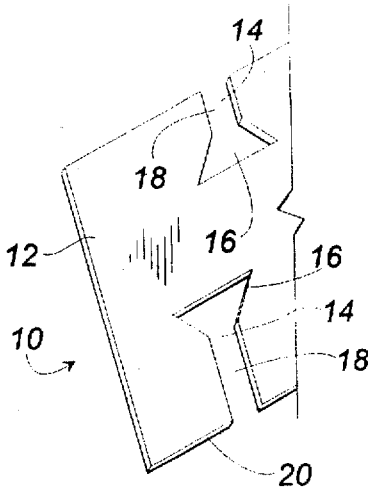
FIG. 2 is a perspective view of a portion of a golf tee insertion height gauge as shown in FIG. 1.

As may also be seen from FIGS. 1 and 2, preferably, the shank portion 18 is disposed perpendicular to the peripheral edge 20 of the sheet 12. Such a disposition of the aperture 14 insures that the golf tee will be vertical when inserted into the ground. Additionally, the width of the shank portion 18 of the aperture 14 is preferably on the order of a width Of the typical golf tee, approximately 3/16", so that a tee inserted into the aperture 14 will have a small range of movement relative to the shank portion 18 of the aperture 14.

This can best be seen with reference to FIG. 2 which in perspective shows a portion of the insertion gauge 10 of FIG. 1, the sheet 12 is preferably relatively thin, and, most preferably, about 3/16" thick. In practice, the diameter of most golf tees is in the range of approximately 3/16". Thus, the thickness of the insertion gauge 10 corresponds generally to the diameter of the shank of a golf tee. This correspondence allows for a more secure fit of the tee within the aperture during insertion of the tee into the ground. This feature is particularly important in hard high clay content soils.

As is shown in FIGS. 1 and 2, the gauge 10 includes a number of apertures 14 to accommodate a variety of insertion heights of golf tees. This allows for the user of the insertion gauge 10 to respond to a variety of changing golf course conditions and adjust the height of his or her ball accordingly. For example, on a typical hole given typical conditions, a golfer may regularly use one of the middle type apertures to have a uniform height above ground of the ball for every swing. However, in high wind conditions, a golfer may desire to tee the ball lower and thus would use one of the deeper insertion apertures.

Although shown in a rectangular embodiment in FIGS. 1 and 2, the sheet 12 may be of a variety of different polygonal shapes and sizes. For example, the sheet 12 might be circular, triangular, pentagonal or any desired polygon. However, regardless of the shape of the sheet 12, it would be important that, for shapes having a linear peripheral edge 20, the shank portion 18 of the aperture 14 be disposed perpendicular to the peripheral edge 20. For the purposes of round or curved sheets 12, the shank portion 18 of the aperture 14 should be disposed perpendicular to a line tangent to the peripheral edge 20 at the point where the shank portion 18 meets the peripheral edge 20.

Figure 3:
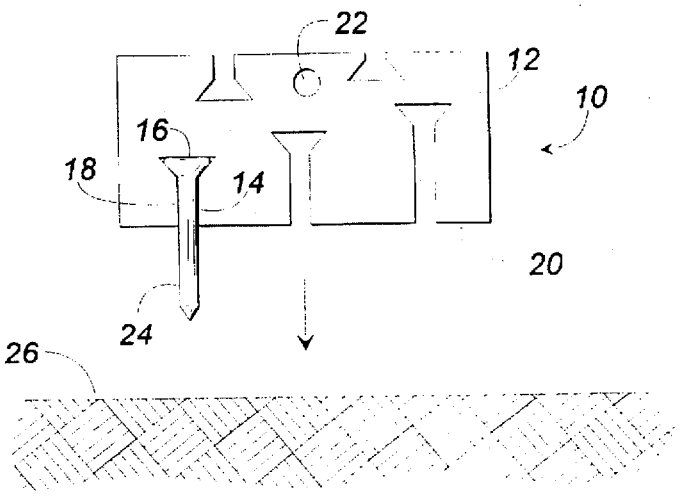
FIG. 3 is a plan view of a golf tee insertion height gauge showing a golf tee being inserted into the ground.

There is also shown, in FIG. 3, an attachment aperture 22 which, in the preferred embodiment, allows for the gauge 10 to be attached to a retention device such a key ring or accessory clip on a golf bag.

FIG. 3 further shows a diagrammatic view of the gauge 10 being used to insert a golf tee 24 into the ground 26. As shown, the golf tee 24 would fit within the aperture 14. More particularly, the head of the golf tee 24 would fit within the head portion 16 of the aperture 14 and, to the extent that the head of the golf tee 24 has a diameter less than the width of the head portion 16, there would be some room between the edges of the head of the golf tee 24 and the sides of the head portion 16 of the aperture 14. However, the shank of the golf tee 24 would fit more exactly to the shank portion 18 of the aperture 14. This is the case since the thickness of the sheet material 12 is preferably selected to correspond to the average width of the shank of a golf tee, which is about 3/16". Thus, the shank of the golf tee 24 will not likely protrude out of the aperture 14 in the shank portion 18 while the head of the golf tee 24 will protrude substantially out of the head portion 16 of the aperture 14. Further, as can be seen from FIG. 3, the head of the tee 24 will engage the upper limit of the head portion 16 of the aperture 14 so that, upon insertion of the tee 24 into the ground 26, the force exerted on the gauge 10 will be transmitted to the tee 24 by contact between the head of the tee 24 and the top of the head portion 16 of the aperture 14. Thus, upon insertion into the ground as by movement and direction of the arrow shown in FIG. 3, the shank of the tee 24 will be inserted into the ground until the peripheral edge 20 of the gauge 10 contacts the ground. At this time, the portion of the tee 24 remaining above the ground will correspond to the desired height about ground for the golf ball. The gauge 10 may then be easily removed and the tee is then ready for placement of the golf ball thereon and play.

As should be readily evident, the golf tee insertion height gauge of the present invention improves on the prior art in many ways. For example, the gauge of the present invention accommodates a wide range of tees 24, including tees 24 with different sized heads, shanks and angles at which the head of the tee 24 tapers to the shank. Further, the gauge of the present invention allows for even application of force upon inserting the tee 24 in the ground due to the contact between the head of the tee 24 and the top portion 16 of the aperture 14 and the contact from the fingers of a user on opposing sides of the tee byway of the front and back of the aperture 14. Also, the gauge of the present invention generally uses less material making it cheaper to produce and generally is lighter in weight making it easier to tote and more comfortable to store in one's pocket or the like. It should be noted that the above are just some, but clearly not all, of the novel, non-obvious improvements of the golf tee insertion height gauge of the present invention over the prior art.

The foregoing description of a preferred embodiment was for the purpose of illustration and not limitation. It is anticipated that the invention is capable of numerous modifications, additions, substitutions, deletions, or other alterations which would not depart from the scope of the invention as set forth in the following claims. For example, although shown in a rectangular shape in the figures, the invention may be incorporated into a variety of shapes not limited to any regular shape. Furthermore, although described as preferably being made of plastic or aluminum, any semi-rigid or rigid sheet material capable of being formed in the desired thickness and having the desired apertures, may be suitable. Finally, while a limited number of apertures is shown in the preferred embodiment, as few as one and many more than five apertures could be placed on a golf tee insertion height gauge of the present invention.

I claim:

1. A golf tee insertion gauge and golf tee removal apparatus for use in accurately positioning the head of a golf tee at a desired height above the ground upon insertion of the golf tee into the ground and for use in easily removing the golf tee from the ground, said golf tee gauge comprising:

a body having a left and a right side and a bottom generally perpendicular to said left and right sides, said body having a peripheral edge;

a series of graduated tee receiving apertures defined within said body;

said graduated tee receiving apertures extending through the width of said body and having an opening on said peripheral edge;

said graduated tee receiving apertures each including a golf tee head conforming portion for accepting the head of a golf tee and defining an upper limit for movement of a golf tee placed within said tee receiving aperture, said golf tee head conforming portion including an upper wall for limiting the upper movement of a golf tee and two opposing side walls extending inwardly from said upper wall at an angle of less than ninety degrees;

said golf tee head conforming portion of said tee receiving apertures being positioned relative to said peripheral edge of said body such that the distance between the upper limit of said golf tee head conforming portion to said peripheral edge corresponds to the desired height above ground of the head of the golf tee with said series of graduated tee receiving apertures each having a head conforming portion at a different distance from said peripheral edge presenting a graduated series of selectable distances;

said graduated tee receiving apertures including a shank conforming portion extending from said head conforming portion to said peripheral edge;

said golf tee head conforming portion and said shank conforming portion defining a cross-section replicating that of a golf tee, wherein said junction of said head conforming portion with said shank conforming portion defines shoulders for engaging the head of a golf tee for supporting said golf tee when said body is in an upright position and also for creating a means for removing a golf tee from the ground;

wherein said graduated tee receiving apertures receive a golf tee within its periphery for supporting the golf tee when said body is in an upright position for facilitating in the accurate vertical and horizontal positioning of a golf tee; and wherein said graduated tee receiving aperture may encircle a golf tee positioned in the ground for removal by engaging the golf tee with shoulders.

* * * * *